US007549196B2

(12) United States Patent
Ziegs et al.

(10) Patent No.: US 7,549,196 B2
(45) Date of Patent: Jun. 23, 2009

(54) TOOL

(75) Inventors: Carsten Ziegs, Hamburg (DE); Willi Strauss, Schonaich (DE)

(73) Assignees: DOLMAR GmbH, Hamburg (DE); SOLO Kleinmotoren GmbH, Sindelfingen (DE)

( * ) Notice: Subject to any disclaimer, the term of this patent is extended or adjusted under 35 U.S.C. 154(b) by 313 days.

(21) Appl. No.: 11/378,556

(22) Filed: Mar. 16, 2006

(65) Prior Publication Data

US 2006/0230623 A1 Oct. 19, 2006

(30) Foreign Application Priority Data

Mar. 17, 2005 (DE) ..... 20 2005 004 316 U

(51) Int. Cl.
*B25G 1/10* (2006.01)

(52) U.S. Cl. ..... 16/430; 16/431

(58) Field of Classification Search ..... 16/430, 16/900, 422, 437, 111.1, 113.1; 409/182; 30/208–222; 190/115
See application file for complete search history.

(56) References Cited

U.S. PATENT DOCUMENTS

| | | | | |
|---|---|---|---|---|
| 3,959,878 | A * | 6/1976 | Irelan et al. | 30/220 |
| 5,065,476 | A * | 11/1991 | Dohse et al. | 16/426 |
| 5,596,810 | A * | 1/1997 | Neubert et al. | 30/369 |
| 6,032,332 | A * | 3/2000 | Lin | 16/111.1 |
| 6,443,675 | B1 * | 9/2002 | Kopras et al. | 409/182 |
| 6,511,369 | B2 * | 1/2003 | Chi | 451/344 |
| 6,548,776 | B1 * | 4/2003 | Jong | 200/334 |
| 6,550,102 | B1 * | 4/2003 | Liang | 16/113.1 |
| 6,619,448 | B1 * | 9/2003 | Wang | 190/115 |
| 2003/0085089 | A1 * | 5/2003 | Lin et al. | 190/115 |

FOREIGN PATENT DOCUMENTS

| | | |
|---|---|---|
| DE | 4021277 A1 | 3/1991 |
| DE | G 93 19 263.0 | 3/1994 |
| DE | 195 32 299 A1 | 3/1997 |

* cited by examiner

*Primary Examiner*—Victor Batson
*Assistant Examiner*—Emily M Morgan
(74) *Attorney, Agent, or Firm*—Kelly Lowry & Kelley LLP

(57) ABSTRACT

The invention pertains to a hand-operated tool (100) with a housing (12) and at least one handle (14) that is arranged on the housing such that it can be turned about an axis (13), wherein said handle comprises handle shells (15, 16) and a bearing part that is mounted on a counter bearing of the housing (12). The invention aims to develop a tool of this type that does not have the above-described disadvantages, particularly to make available a simple and inexpensive tool that can be easily assembled, and proposes that the first handle shell (15) and the bearing part are realized in one piece and the second handle shell (16) to be mounted on the first handle shell (15) is realized without a bearing part.

22 Claims, 3 Drawing Sheets

TOOL

Figure 1:
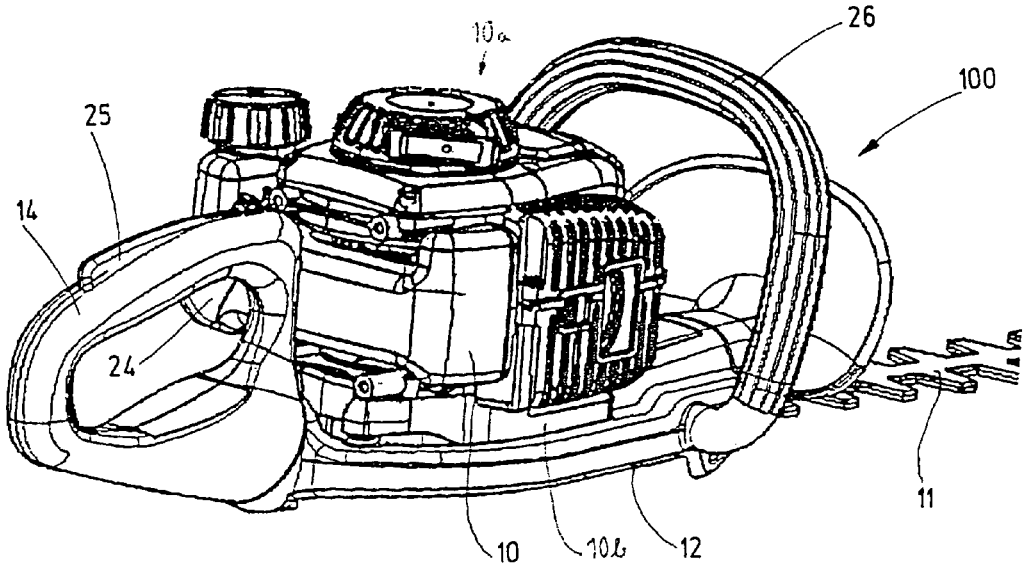

The invention pertains to a hand-operated tool with a housing and at least one handle that is arranged on the housing such that it can be turned about an axis, wherein said handle comprises handle shells and a bearing part that is mounted on a counter bearing of the housing.

When using generally known hand-operated tools such as, in particular, chain-saws, cut-off grinders, right-angle grinders, blowers, vacuums, hedge clippers, etc., it is possible to individually adjust an ergonomic configuration of the tool for the user by turning the motor housing relative to the handle. This enables the user to select the most favorable handle position in dependence on the respective requirements. However, tools of this type have, among the things, the disadvantage that the handle mechanism (locking lever mechanism, throttle lever mechanism, stopping mechanism, rotary locking mechanism, etc.) initially needs to be installed into one or both handle shells during the assembly process before the handle shells can be connected to one another with screws. The handle can then be mounted on the housing. If it is necessary to gain access to the mechanism arranged within the handle for servicing purposes, the disassembly of the handle is relatively complicated because it needs to be initially removed from the housing before the handle shells can be separated. It is frequently unavoidable that the handle mechanism falls apart once the handle is separated, in which case the required maintenance and repair procedures become even more complicated.

DE 195 46 328 A1 describes a hand-operated tool with a motor housing for accommodating an electromotive drive for the tool, particularly a grinding wheel or a cut-off wheel, wherein the motor housing carries a bearing journal on its side that faces away from the tool. A handle that is composed of two shell-like handle halves is rotatably seated on the bearing journal. A bearing shell for being rotatably seated on the bearing journal is integrally formed onto each handle shell. In addition, a blind bore is arranged in the end face of the bearing journal such that it can be secured against axial displacements, wherein a sleeve is inserted into said blind bore. The sleeve overlaps the end faces of the bearing journal and the bearing shell with a radial flange realized on its end face and engages into radial recesses in the bearing journal with hooks arranged on or near its distant end referred to the flange. In addition to the large number of components, the bearing of this handle consists of two parts such that the first and the second handle shell respectively comprise a bearing part. This is disadvantageous with respect to the stability of the handle, particularly when turning the handle about the axis of rotation. In addition, the assembly and disassembly become more complicated due to the additional components required for preventing axial displacements.

The present invention is based on the objective of developing a hand-operated tool that does not have the above-mentioned disadvantages, particularly of making available a simple and inexpensive tool that can be easily assembled. This objective is attained with a tool with the characteristics disclosed in claim 1. Preferred additional developments are disclosed in the dependent claims.

According to invention, the first handle shell and the bearing part are realized in one piece, and the second handle shell to be mounted on the first handle shell is realized without a bearing part. The significant advantage of the invention can be seen in that a closed bearing part is provided on one handle shell only and mounted on the counter bearing of the housing in the assembled state. This results in a stable support of the handle on the housing such that forces occurring while the tool is used can be effectively absorbed. If the handle needs to be opened for repair purposes, it is possible to merely detach the second handle shell that does not contain a bearing from the first handle shell, wherein the first handle shell remains mounted on the counter bearing of the housing. This means that the user is provided with full access to the handle mechanism arranged in the first handle shell, namely without the handle mechanism falling apart into its individual components. The user is able, for example, to repair the mechanism or to exchange a defective part without complicated assembly procedures. The first and the second handle shell are preferably connected to one another in a non-positive and/or positive fashion. For example, it would be conceivable to utilize a screw connection for this purpose.

In an alternative embodiment of the invention, the bearing part is realized in the form of a bearing sleeve and the counter bearing is realized in the form of a bearing journal. In this case, the bearing sleeve may consist of a closed annular enclosure that essentially accommodates the bearing journal in its entirety—in the mounted state of the handle. The essentially cylindrical bearing journal is preferably realized in one piece such that the tool according to the invention comprises fewer parts than comparable devices known from the state of the art. In addition to reducing the number of individual parts, the invention also makes it possible to significantly shorten the assembly time. Furthermore, the bearing journal and the bearing sleeve can be well adapted to one another with respect to the tolerances.

In another embodiment of the invention, a safety device is provided for preventing the handle from loosening from the housing in the axial direction along the axis of rotation. In one embodiment of the invention, the safety device may feature a circumferential groove that corresponds to at least one recess in the bearing sleeve. The second handle shell preferably comprises at least one safety element that extends through the recess and engages into the groove. In one preferred embodiment, the tool features two recesses and two safety elements that may be realized, for example, in the form of a pin. The safety elements preferably are integrally formed onto the second handle shell such that an axial safety element is created in cooperation with the groove and the recesses.

In another alternative embodiment of the invention, an annular sealing element, for example, in the form of an O-ring is arranged on the bearing journal. In this case, the O-ring is arranged around the bearing journal and reliably seals the bearing point against dirt and debris. The safety elements of the second handle shell simultaneously build up tension in the axial direction that interacts with the sealing element. When the second handle shell is attached, the sealing element is slightly pressed against the pins by bevels such that a reliable seal is achieved. The counter bearing is preferably realized in one piece such that the sealing element essentially extends on a plane, circular surface without seams or abutments and therefore is not subjected to wear.

In one embodiment of the tool, the handle can be continuously turned along the axis of rotation. It would also be conceivable that the handle and the housing feature releasable locking elements in order to fix the handle in different positions along the axis of rotation. The handle preferably has a maximum angle of rotation of 180°, wherein the handle can be locked in at least 3 positions, preferably in 5, 7 or 9 positions. In such an embodiment, it is sensible to arrange the position for the normal handling of the tool in the center of the overall angle of rotation (pivoting angle) such that the handle can be respectively pivoted toward each side by a pivoting angle of 90° from this center position.

In one additional development of the invention, an element for limiting the maximum angle of rotation may be provided between the housing and the handle. Such an embodiment of the invention prevents multiple rotations of the handle about the housing that could lead to damages, for example, of electric connecting lines between the handle and the housing.

In one advantageous embodiment, the first handle shell features at least one opening in the region of the bearing part that cooperates with several openings on the counter bearing of the housing. The openings on the bearing part as well as on the counter bearing may be realized in the form of circular openings and/or depressions. In the arrested (locked) position of the handle, a locking bolt extends through the opening of the bearing part and engages into one of the openings of the housing. The locking bolt can be disengaged, for example, by actuating a touch-trigger element that is arranged on the housing or on the handle and coupled or functionally connected to the locking means. The openings of the housing and/or the first handle shell may be arranged along a circular path around the axis of rotation in one embodiment of the invention.

It may also be advantageous to accommodate the locking bolt in a bore of the handle that is realized in one piece. In such an embodiment, the connecting means—for example, the screw connections—between the two handle shells are not subjected to an additional load when the handle is turned about the axis of rotation.

It is preferred to provide means that prevent the handle from being unintentionally unlocked during the operation of the tool. This constructive feature represents a significant contribution to occupational safety because it can be reliably prevented that the handle is unlocked while the motor is running or, vice versa, that the motor can be started while the handle is unlocked.

Figure 2:
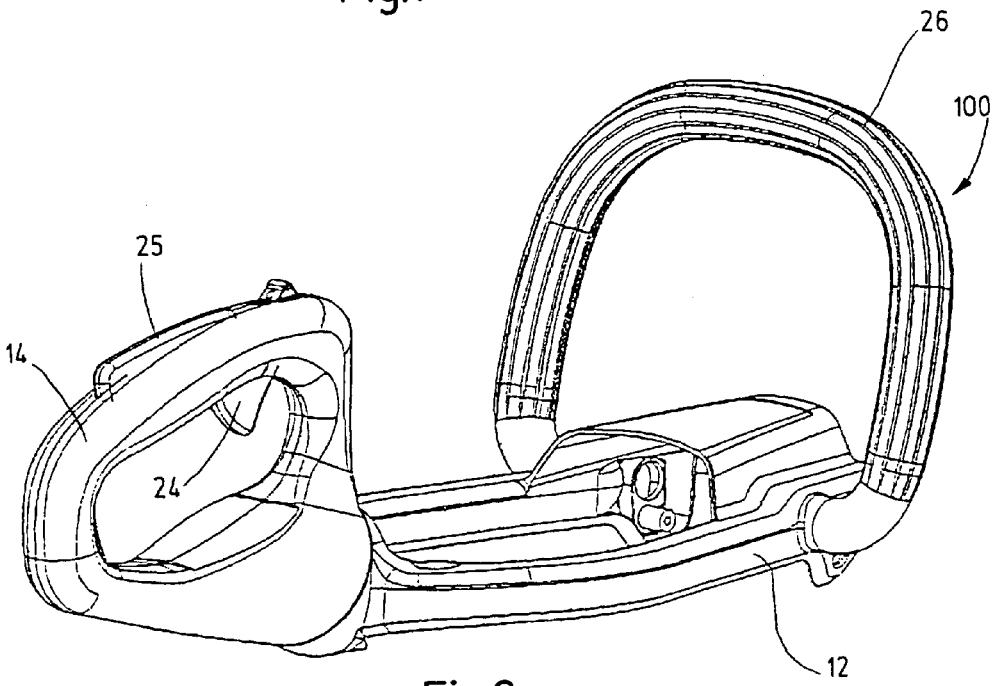
Figure 3:
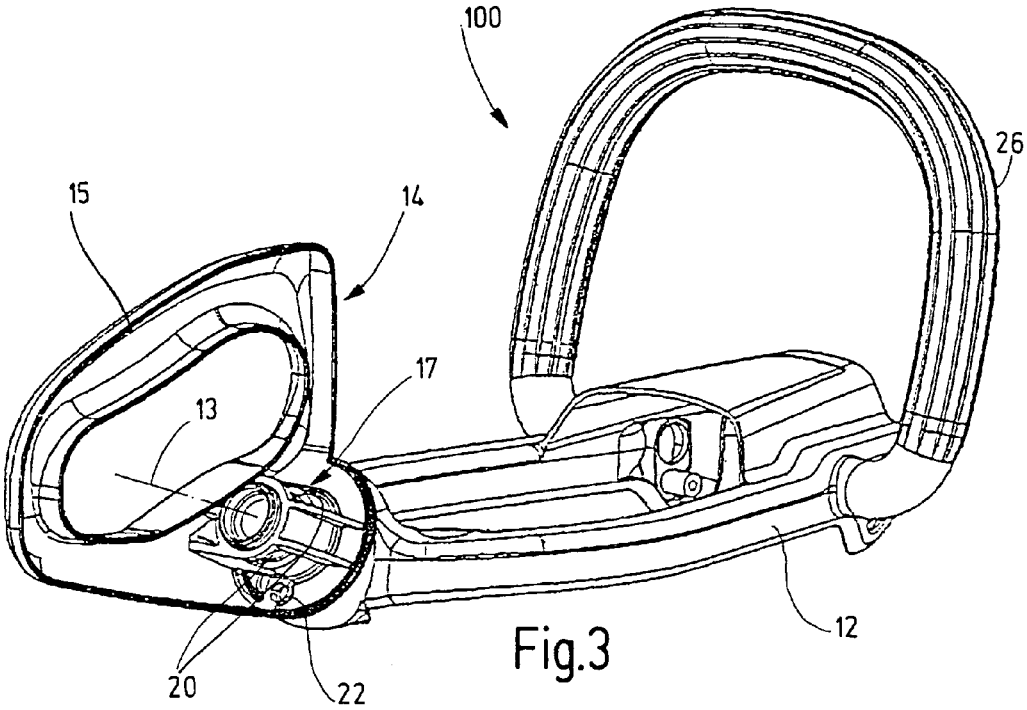
Figure 4:
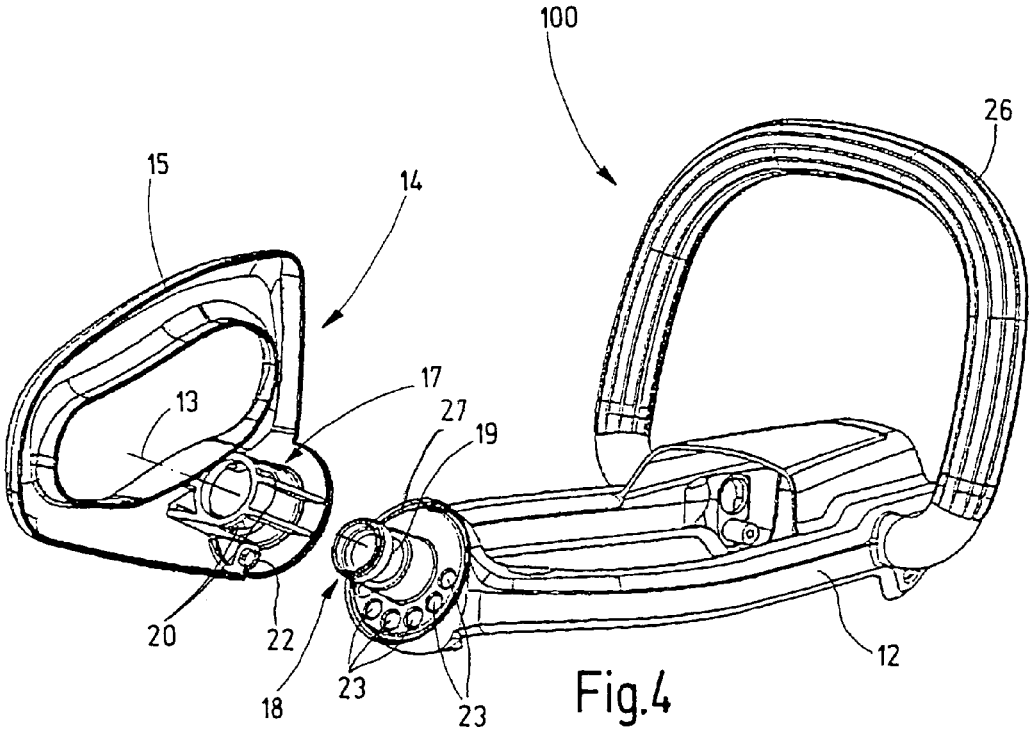
Figure 5:
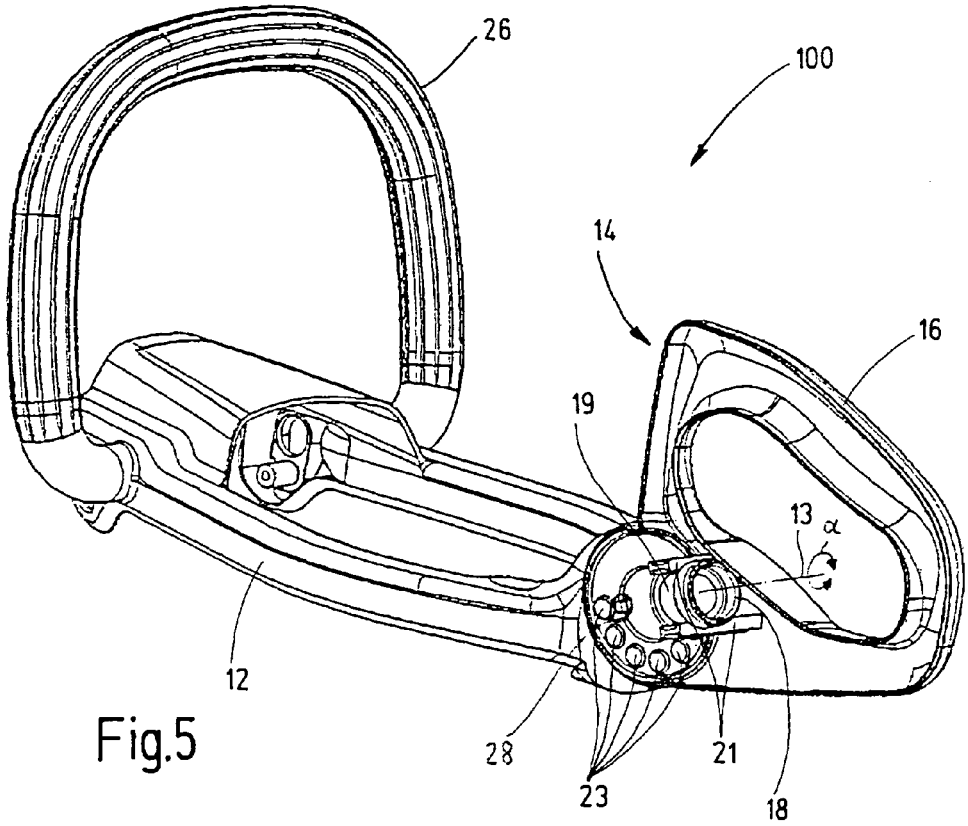
Figure 6:
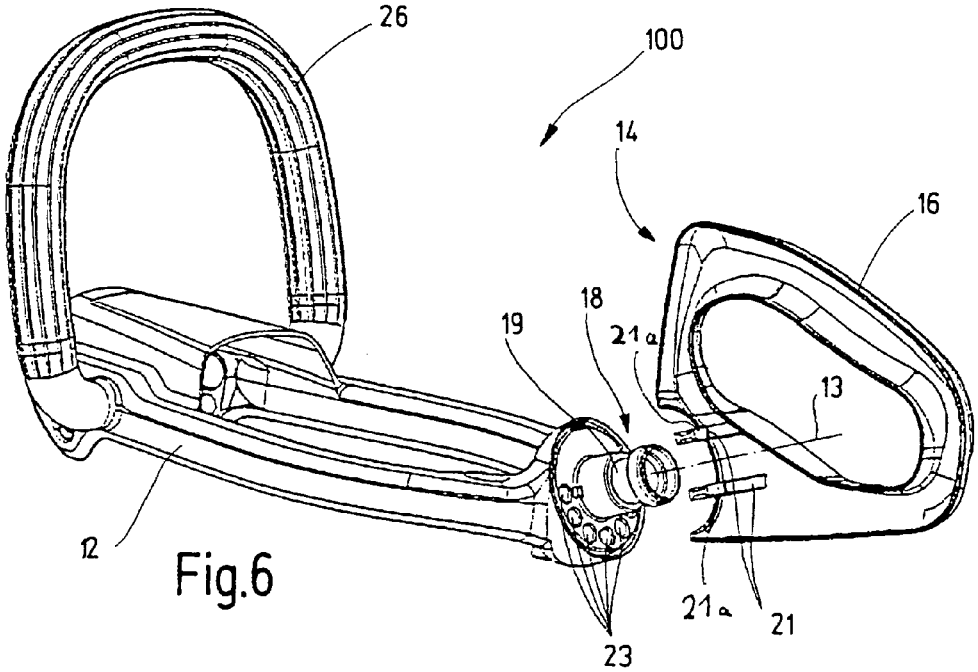

Other advantages, characteristics and details of the invention result from the following description, in which one embodiment of the invention is described in greater detail with reference to the figures. In this context, it should be noted that the respective characteristics disclosed in the claims and in the description may be essential to the invention individually or in arbitrary combinations. The figures schematically show:

FIG. 1, a perspective representation of hedge clippers with a motor, a housing, as well as a front and a rear handle;

FIG. 2, an aspect of the housing according to FIG. 1;

FIG. 3, an aspect of the housing according to FIG. 2, wherein only the first handle shell of the front handle is arranged on the housing;

FIG. 4, another aspect of the housing according to FIG. 3;

FIG. 5, another aspect of the housing according to FIG. 2, wherein only the second handle shell of the front handle is arranged on the housing, and FIG. 6, another aspect of the housing according to FIG. 5.

The portable, hand-operated tool 100 shown in FIGS. 1-6 consists of hedge clippers. FIG. 1 shows a drive unit 10 of the hedge clippers 100 that consists of an internal combustion engine 10*a* in the embodiment shown. The internal combustion engine 10*a* is realized in the form of a single-cylinder two-stroke engine. Naturally, the drive unit 10 for the hedge clippers 100 may also be realized in the form of an electric motor rather than an internal combustion engine 10*a*. The internal combustion engine 10*a* is mounted on the housing 12 and drives a tool 11 via a gear 10*b*. FIGS. 2-6 clearly show that the housing 12 comprises a receptacle region that is open on the top/bottom and serves for accommodating the internal combustion engine 10*a*.

A rear handle 14 is arranged on the side of the housing 12 that faces away from the tool 11. FIGS. 2-6 show that the handle 14 is composed of a first handle shell 15 and a second handle shell 16. The handle 14 is provided with an opening, through which a touch-trigger element 24 protrudes, wherein said touch-trigger element may be realized in the form a throttle lever or an actuating lever for an electric speed controller/variable speed gear depending on the type of drive unit used. The touch-trigger element 24 may be connected to the engine speed sensor, for example, via a Bowden cable that extends within the handle 14 in an alternative embodiment that is not illustrated in the figures. A throttle lever lock 25 is also arranged on the handle 14.

An essentially U-shaped front handle 26 is arranged on the housing 12 in order to carry and manipulate the hedge clippers 100. The bow-shaped handle 26, the surface of which is provided with grooves in order to improve the grip, as well as the rear handle 14 consist of a plastic material in the embodiment shown. The front handle 26 may also consist of a profiled aluminum body or be composed of several parts/pieces in an alternative embodiment of the invention.

The handle 14 comprises a bearing part in the form of a bearing sleeve 17. In the assembled state, the handle 14 forms a hollow body, in which various handle mechanisms (locking lever mechanism, throttle lever mechanism, etc.) are accommodated. The bearing sleeve 17 protrudes into the hollow body of the handle 14. On the opposite side of the tool 11, the housing is provided with a counter bearing in the form of a bearing journal 18, on which the bearing sleeve 17 can be mounted. The bearing part in the form of a bearing sleeve 17 and the counter bearing in the form of a bearing sleeve 17 [sic] form a bearing point for the handle 14, wherein the handle 14 is supported on said bearing point such that it can be turned about an axis of rotation 13. The counter bearing may be integrally connected to the housing 12.

According to FIGS. 3 and 4, the first handle shell 15 and the bearing sleeve 17 are realized in the form of one part/piece, wherein the bearing sleeve 17 consists of a closed annular enclosure. The counter bearing is realized in the form of a bearing journal 18 that is accommodated by the bearing sleeve 17. The second handle shell 16 contains no bearings (see FIGS. 5 and 6). The handle 14 can be pivoted into defined positions about an axis of rotation 13, wherein the rotational movement about the axis of rotation 13 is respectively limited to a maximum value of the angle of rotation $\alpha$ by limit stops (FIG. 5 shows one limit stop 28).

A circumferential groove 19 is arranged on the bearing journal 18, in particular, in order to axially secure the handle 14. The first handle shell 15 features recesses 20 that correspond to the groove 19, wherein pins 21 that are integrally formed onto the second handle shell 16 protrude through said recesses and engage into the groove 19. In the embodiment shown, the bearing sleeve 17 contains two recesses 20 (openings). Accordingly, the inner side of the second handle shell 16 is provided with two pins 21 that extend a certain distance from one another. The distance between the pins 21 and the diameter of the groove 19 are adapted to one another in such a way that the handle 14 is securely held on the bearing journal 18 in the axial direction and the user is simultaneously able to easily turn the handle 14. In addition, tension is built up in the axial direction at the bearing point by the pins 21, particularly the bevels 21*a*, wherein this tension interacts with a not-shown O-ring that is arranged around the bearing journal 18 and the groove 17, respectively.

FIGS. 4-6 show locking means 22, 23 that are arranged on the handle 14 and on the housing 12 in order to lock the handle 14 in different positions along the axis of rotation 13. The first handle shell 15 features a circular opening 22 in the region of its bearing sleeve 17. This opening 22 cooperates with a plurality of openings 23 on the bearing journal 18 of the handle 14. One can clearly ascertain that the openings 23 of the bearing journal 18 are arranged along a circle with a certain radius around the axis of rotation 13. In the locked position of the handle 14, a not-shown locking bolt extends through the opening 22 of the bearing sleeve 17 and engages into one of the openings 23 of the bearing point that are realized in the form of circular depressions such that the handle is locked. The locking bolt is preferably supported in a bore that is realized in one piece.

One of the significant advantages of the invention can be seen in that the ease of maintenance is improved because the first handle shell 15 remains mounted on the housing 12 when the handle is disassembled. The user has easy access to the handle mechanism that is safely accommodated by the inner wall of the first handle shell 15. In addition, the risk of the handle 14 and its mechanisms falling apart into individual components during the disassembly of the handle is eliminated. A stable bearing point for the rotatable handle 14 is also created because the bearing sleeve 17 and the bearing journal 19 are respectively realized in one piece.

The invention claimed is:

1. A hand-operated tool (100) with a housing (12) and at least one handle (14) that is arranged on the housing such that it can be turned about an axis (13), wherein said handle comprises first and second handle shells (15, 16) and a bearing part that is mounted on a counter bearing of the housing (12), characterized in that the first handle shell (15) and the bearing part are realized in one piece and the second handle shell (16) to be mounted on the first handle shell (15) is realized without a bearing part, wherein the bearing part includes a bearing sleeve (17), and the counter bearing includes a bearing journal (18), a safety device (19, 20, 21) that prevents the handle (14) from loosening from the housing (12) in the axial direction along the axis of rotation (13), wherein the safety device (19, 20, 21) features a circumferential groove (19) on the bearing journal (18) that corresponds to at least one recess (20) in the bearing sleeve (17), and wherein the second handle shell (16) features at least one safety element that extends through the recess (20) and engages into the groove (19).

2. The tool according to claim 1, characterized in that the safety element is realized in the form of a pin (21).

3. The tool according to claim 1, characterized in that the handle (14) and the housing (12) feature releasable locking means for locking the handle (14) in different positions along the axis of rotation (13).

4. The tool according to claim 3, characterized in that the maximum angle of rotation a of the handle (14) about the axis of rotation (13) is limited.

5. The tool according to claim 4, characterized in that the angle of rotation a of the handle (15) is 180°, wherein the handle (14) can be locked in at least three positions.

6. The tool according to claim 5, characterized in that an element (28) for limiting the maximum angle of rotation is arranged between the housing (12) and the handle (14).

7. The tool according to claim 1, characterized in that the bearing sleeve (17) comprises a closed annular enclosure.

8. The tool according to claim 1, characterized in that the bearing journal (18) is realized in one piece.

9. A hand-operated tool (100) with a housing (12) and at least one handle (14) that is arranged on the housing such that it can be turned about an axis (13), wherein said handle comprises first and second handle shells (15, 16) and a bearing part that is mounted on a counter bearing of the housing (12), characterized in that the first handle shell (15) and the bearing part are realized in one piece and the second handle shell (16) to be mounted on the first handle shell (15) is realized without a bearing part, wherein the bearing part includes a bearing sleeve (17), and the counter bearing includes a bearing journal (18), wherein the housing (12) features releasable locking means for locking the handle (14) in different positions along the axis of rotation (13), and wherein the first handle shell (15) features at least one opening (22) that is arranged in the region of the bearing part and cooperates with several openings (23) on the counter bearing of the housing (12), wherein a locking bolt extends through the opening (22) of the bearing part and engages into one of the openings (23) of the housing (12) in the locked position of the handle (14).

10. The tool according to claim 9, characterized in that the locking bolt is accommodated in a bore of the handle (14) that is realized in one piece.

11. The tool according to claim 9, characterized in that the openings (22, 23) of the housing (12) and/or the first handle shell (15) are circularly arranged around the axis of rotation (13).

12. The tool according to claim 9, characterized in that an annular sealing element is arranged in a groove (27) in the region of the bearing journal (18).

13. The tool according to claim 12, characterized in that the annular sealing element consists of an O-ring.

14. The tool according to claim 9, characterized in that the first handle shell (15) and the second handle shell (16) are non-positively or positively connected to one another.

15. The tool according to claim 9, characterized in that the first and the second handle shell (15, 16) consist of a plastic material.

16. The tool according to claim 15, characterized in that the handle (14) consists of a hollow plastic body.

17. The tool according to claim 16, characterized in that the first and the second handle shell (15, 16) consist of injection-molded parts.

18. The tool according to claim 17, characterized in that the plastic material contains a certain percentage of a stabilizing filler.

19. The tool according to claim 9, characterized in that a trigger element (24) is arranged within the handle (14).

20. The tool according to claim 9, characterized in means for preventing the locking means (22, 23) from being unintentionally released while an internal combustion engine (10*a*) of the tool is running.

21. The tool according to claim 9, including a safety device (19, 20, 21) that prevents the handle (14) from loosening from the housing (12) in the axial direction along the axis of rotation (13).

22. The tool according to claim 21, characterized in that the safety device (19, 20, 21) features a circumferential groove (19) on the bearing journal (18) that corresponds to at least one recess (20) in the bearing sleeve (17).

* * * * *

UNITED STATES PATENT AND TRADEMARK OFFICE

CERTIFICATE OF CORRECTION

PATENT NO. : 7,549,196 B2
APPLICATION NO. : 11/378556
DATED : June 23, 2009
INVENTOR(S) : Carsten Ziegs et al.

It is certified that error appears in the above-identified patent and that said Letters Patent is hereby corrected as shown below:

In column 5, line 50 (claim 4), replace "a" with -- α --.

In column 5, line 53 (claim 5), replace "a" with -- α --.

Signed and Sealed this
Eighteenth Day of October, 2011

David J. Kappos

David J. Kappos
*Director of the United States Patent and Trademark Office*